US007021387B2

(12) United States Patent
Lee

(10) Patent No.: US 7,021,387 B2
(45) Date of Patent: Apr. 4, 2006

(54) WELLBORE PUMP

(75) Inventor: Dan Lee, Calgary (CA)

(73) Assignee: Natural Lift Systems Inc., (CA)

( * ) Notice: Subject to any disclaimer, the term of this patent is extended or adjusted under 35 U.S.C. 154(b) by 7 days.

(21) Appl. No.: 10/334,920

(22) Filed: Dec. 31, 2002

(65) Prior Publication Data

US 2003/0215337 A1 Nov. 20, 2003

(30) Foreign Application Priority Data

Apr. 19, 2002 (CA) ..... 2382637

(51) Int. Cl.
*F04B 47/12* (2006.01)
*E21B 43/00* (2006.01)

(52) U.S. Cl. ..... 166/372; 166/105; 417/56; 417/57; 417/60

(58) Field of Classification Search ..... 166/68.5, 166/68, 105, 372; 417/56, 57, 60

See application file for complete search history.

(56) References Cited

U.S. PATENT DOCUMENTS

| | | | | |
|---|---|---|---|---|
| 4,986,727 | A * | 1/1991 | Blanton | 417/57 |
| 6,637,510 | B1 * | 10/2003 | Lee | 166/108 |
| 6,851,480 | B1 * | 2/2005 | Swoyer et al. | 166/372 |
| 2003/0141051 | A1 * | 7/2003 | Abbott et al. | 166/53 |

* cited by examiner

*Primary Examiner*—Kenneth Thompson
(74) *Attorney, Agent, or Firm*—McKee, Voorhees & Sease, P.L.C.

(57) ABSTRACT

The wellbore pump of the present invention comprises a plunger having passage means which may be open or closed by a valve operated by a piston which is biased in the open position by a spring of selected strength such that the wellbore pressure may overcome the spring to close the valve when the accumulated hydrostatic pressure reaches a certain value. When the valve closes the reservoir pressure forces the plunger to the surface and causes the accumulated liquids to be pumped out of the wellbore. A stem extending from the top of the piston engages a top plate and causes the valve to open when the plunger reaches the top of the wellbore. Means is provided whereby the valve opens when it reaches the top of the wellbore and a latch may be provided to retain the plunger from returning to the bottom of the well.

16 Claims, 8 Drawing Sheets

WELLBORE PUMP

This invention relates to apparatus for the improved production of oil and natural gas wells. In particular, it relates to a mechanism which will automatically discharge accumulated liquids from the wellbore, without external force or energy.

Natural gas wells, unlike some oil wells, because of gases light weight and the capacity to expand when pressure is relieved, are able to flow naturally as a result of reservoir pressure without the need to be pumped as is the case in low pressure oil wells.

This phenomena is, however, subject to the exception that associated fluids in the nature of liquid such as water, oil, or petroleum condensates, tend to accumulate in the wellbore and when they reach a certain volume or hydrostatic head in the wellbore create a back pressure which is enough to diminish the flow of natural gas or stop it all together.

CROSS-REFERENCE TO RELATED APPLICATIONS

Applicant claims priority to foreign application, Canadian Serial No. 2,382,637 filed Apr. 19, 2002, which applications are hereby incorporated by reference in its entirety.

BACKGROUND OF THE INVENTION

The solution, of course, is to periodically pump the liquids out of the wellbore when they restrict the flow.

One way to accomplish this is to insert a pumping or swabbing device through an entry chamber known as a lubricator and lower the device to the bottom of the well where by means of rods or cables the pump can be operated to pull liquids up to the surface where the liquids are caused to flow off through the same production line as the natural gas and are then separated. Once the accumulated heavy liquids are removed, the natural rate of gas flow resumes until more liquids eventually accumulate.

The foregoing method, however, involves workers' time and attention at periodic intervals and the use of pumping equipment which in the case of the well under pressure can be complicated, as well as dangerous.

It is therefore the purpose of this invention to provide a means for removing accumulated liquids from oil or natural gas wells (a process generally referred to as swabbing) by means of apparatus which is simple and relatively inexpensive. It is also the purpose of this invention to provide a mechanism which will function automatically without the attention and intervention of workers.

It is also the purpose of this invention to provide apparatus which will operate under the forces provided by the pressure of the gas reservoir without requiring externally applied forces or energy to operate the pump.

SUMMARY OF THE INVENTION

These objects and other advantages are sought to be achieved by means of a wellbore pump mechanism comprising: a plunger having a body of generally cylindrical proportions with an external cross-section smaller than the internal diameter of the wellbore, a series of seals extending from the outer surface of the plunger to form a fluid seal against the inner wall of the wellbore. The plunger has passage means to allow fluids to pass therethrough and a valve mounted within the body of said plunger which is biased in the open position whereby to allow fluids to travel through said valve, past said plunger, in an upward vertical direction through the wellbore.

The valve is biased in the open position by a piston and a spring mechanism of selected strength and force, the spring being held in cylinder chamber isolated by the piston sealed against the inner diameter of said cylinder. The spring is selected such that its force is overcome by a selected hydrostatic pressure acting on the opposite side of the piston which is achieved when fluids in the well reach a certain hydrostatic head. When the valve is closed it prevents further flow through the plunger causing the reservoir pressure to build up beneath the plunger and forcing it to the surface and causing the liquid in front of it to be pumped to the surface and out of the well.

A stem extending from the piston and protruding above the plunger serves to open the valve when the plunger reaches the top of the wellbore.

The mechanism and operation of the invention may be better understood by a detailed description of one embodiment thereof with reference to the attached drawings in which:

DETAILED DESCRIPTION OF THE PREFERRED EMBODIMENTS

Figure 1:
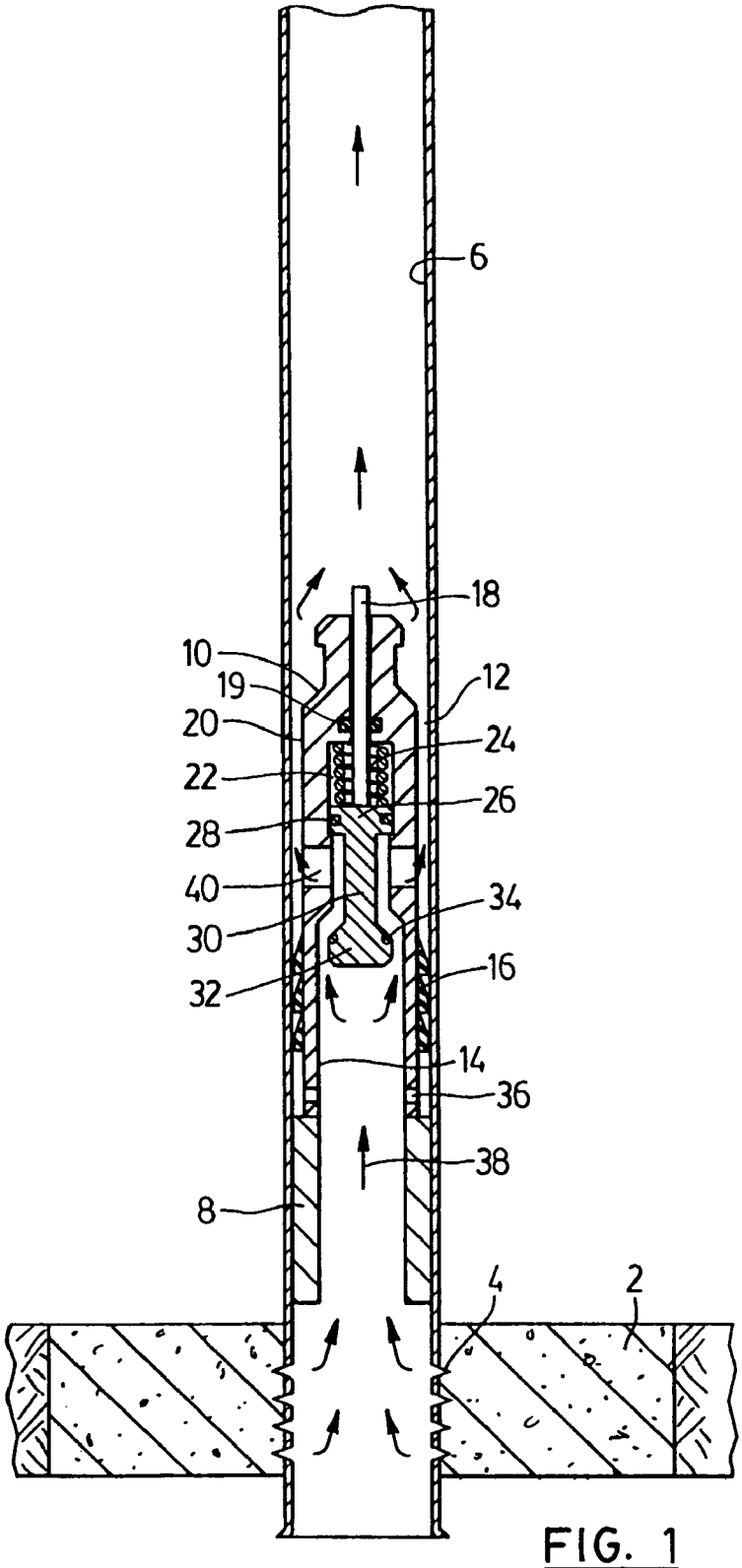
FIG. 1 is a vertical cross-section of a wellbore containing a pump mechanism of the present invention in the open position with production flowing.

In the illustrated embodiment of FIG. 1 a natural gas reservoir 2 is producing natural gas through perforations 4 into the wellbore 6 which is a string of hollow pipe extending to the well head at the surface.

Above the reservoir formation is a collar 8 mounted in the wellbore at a fixed location and presenting a hollow centre with a reduced internal diameter.

Resting on top of the collar is a plunger 10 of the elongated generally cylindrical configuration of smaller diameter than the wellbore so as to provide an annular gap or space 12 between the plunger and the internal surface of the wellbore 6.

The plunger has a lower end 14 with a substantially hollow core and having seals 16 mounted on the outer surface thereof capable of forming a seal between the plunger and the inner surface of the wellbore.

The upper end 20 of the plunger 10 has a cylinder chamber 22 housing a spring 24 which extends between the upper end of the chamber and the chamber end of the piston 26. A stem 18 extends from the top of the piston 26 and protrudes above the top of the plunger 20. Seals 19 serve to insulate the chamber above the piston from wellbore pressures.

The piston 26 is sealed at 28 against the inner wall of the chamber and the piston arm 30 extends downwardly into the hollow opening of the lower portion 14 of the plunger and is attached at its lower end to a valve 32 having a seal mounted on the shoulder thereof at 34.

Hole 36 assures that the pressure of the producing wells is exposed to the plunger at the underside of the seals across the whole diameter of the wellbore.

It will be seen from the arrows 38 that natural gas produced from the reservoir through the perforations travels upwards through the collar 8 through the lower end of the plunger 14, through the valve and out of the plunger through the ports 40 into the annular area 12 (above the seals 16) and onwards and upwards past the plunger to rise through the wellbore to the surface where it is directed away from the well head by production lines to a collection or separation or refinery facility.

Figure 2:
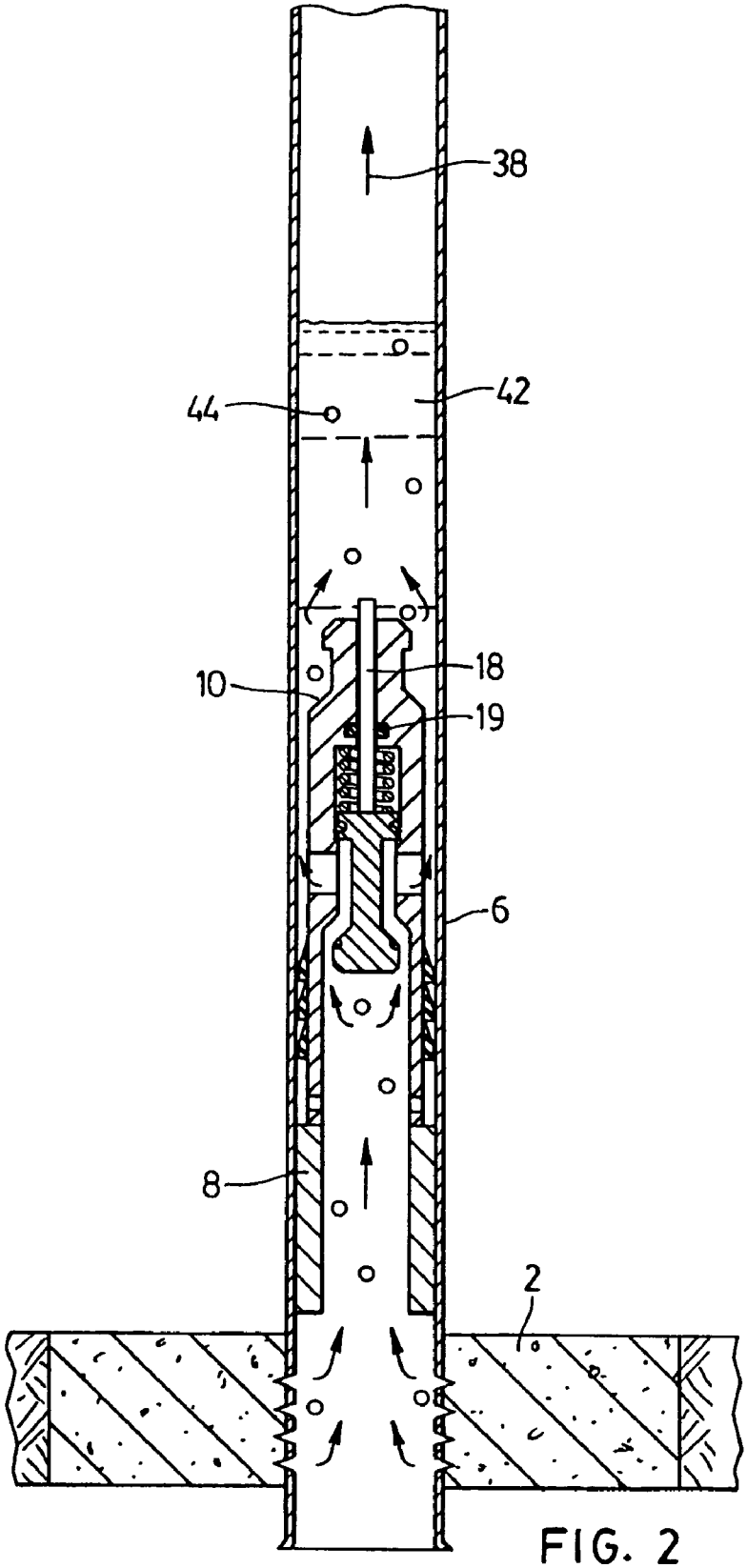
FIG. 2 is vertical cross-section similar to FIG. 1 showing the accumulation of heavy liquids.

However, as illustrated in FIG. 2, the production of natural gas is frequently associated with some amounts of water (especially in wells reaching the end of their life), or oil which is accumulated with gas, or condensate which is a form of hydrocarbon which is carried by the gas stream but separates as a liquid in the wellbore. These liquids being heavier than the natural gas accumulate in the bottom of the wellbore as illustrated at 42 in FIG. 2 with gas bubbles 44 rising through the liquid to the top of the well.

As can be seen in FIG. 2, the flow of fluids follows a similar path described above and illustrated in FIG. 1. However, it will of course be realized that under certain conditions, especially older wells where the reservoir pressure is being depleted, a column of water and/or oil and/or condensate will eventually create a back pressure which will restrict or stop the flow of fluids from the reservoir and the liquids must be removed in order to maintain production.

Figure 3:
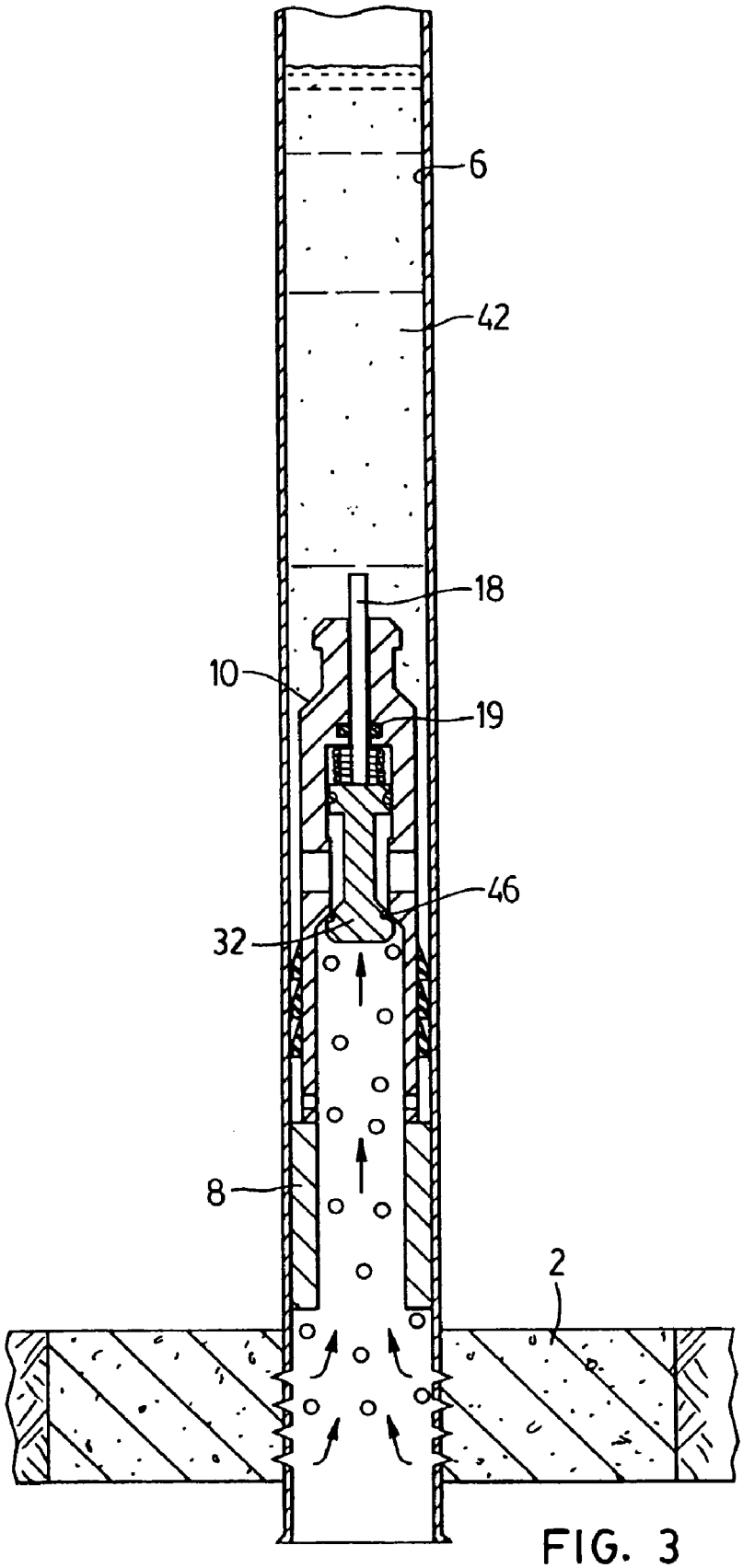
FIG. 3 is a cross-section similar to FIG. 2 showing the valve in the closed position.
Figure 4:
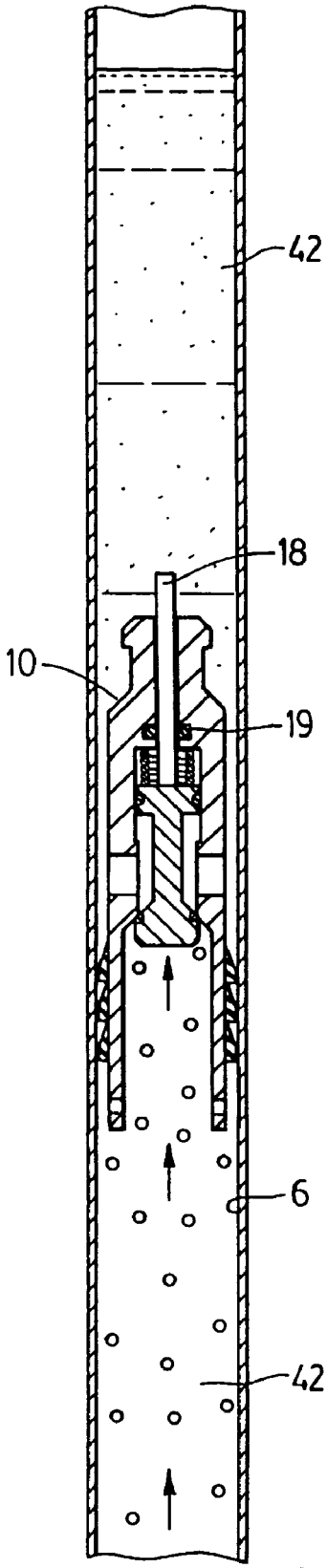
FIG. 4 is a vertical cross-section similar to FIG. 3 showing the plunger rising to the surface pushing fluids ahead of it.

As illustrated in FIG. 3, when the hydrostatic head of liquids reaches a certain value, the hydrostatic pressure generated thereby will remain less than the formation pressure for a period of time and the formation continues to produce until pressure builds up below the valve 32 and the piston 26. At a certain point the pressure on this piston is sufficient to overcome the strength of the spring and compress it causing the valve 32 to close by means of the seal 34 against the shoulder 46 of the plunger. This precludes any further flow through the ports 40 and results in a build up of pressure below the plunger by reason of the seals 16 so that eventually the reservoir pressure forces the plunger to rise off the collar 8 and move vertically upwards in the wellbore driving the column of fluids 42 ahead of it as illustrated in FIG. 4.

It should be noted that the piston 26 has seals 28 and the stem 18 has seals 19 which effectively isolate the chamber 22 housing the spring 24 from wellbore pressure so that closure of the valve requires only that wellbore pressure be sufficient to overcome the strength of the spring (plus perhaps any residual atmospheric pressure in the chamber).

Thus, at the appropriate time, when the back pressure from the accumulated liquids has caused enough pressure to collapse the spring 24, the valve will close and the plunger will, under reservoir pressure, automatically pump the accumulated liquids to the surface thereby conducting the swabbing operation automatically at intermittent intervals.

Figure 5A:
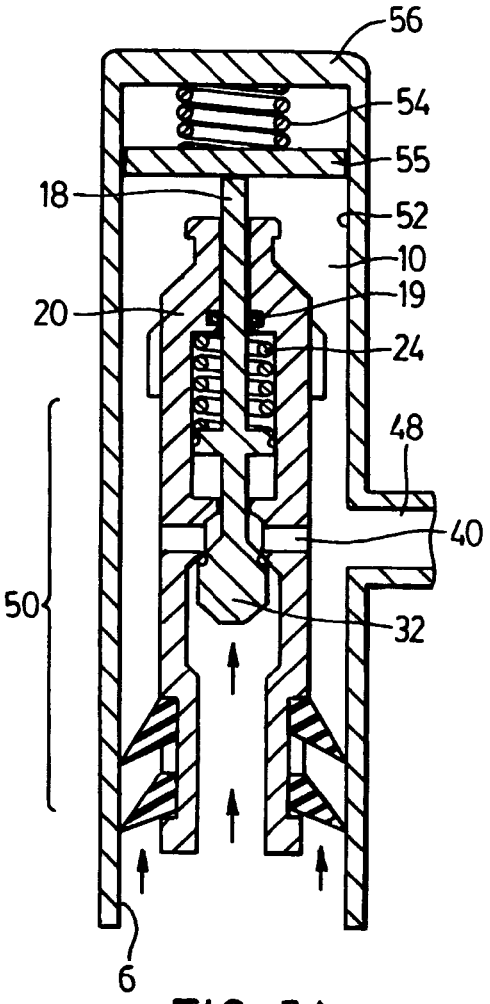
FIG. 5A is a vertical cross-section of the well showing the plunger drawing at the surface in the closed position.
Figure 5B:
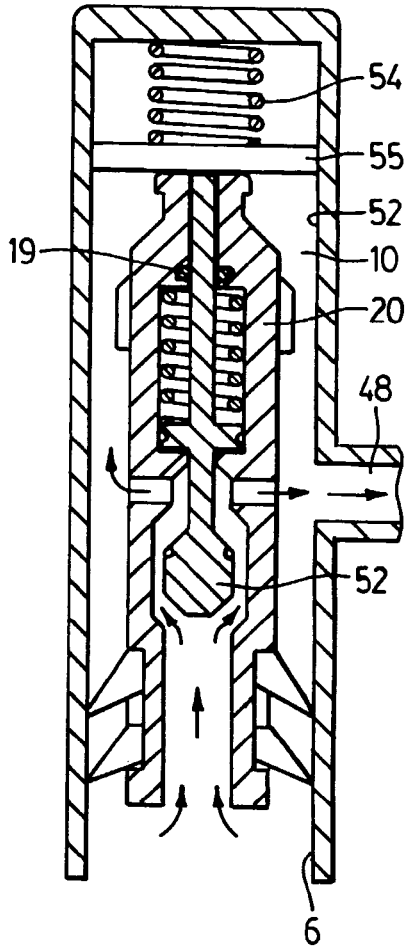
FIG. 5B shows the plunger at the surface in the open position.

The operation at the well head is illustrated in a simplified fashion in FIGS. 5A and 5B. At the top of the wellbore 6 a flow line 48 carries off the produced natural gas as well as the associated water, oil, or condensate forced to the top by the plunger and all fluids are taken to a facility where they are appropriately separated and/or treated.

Above the well head shown schematically at 50, is a chamber known as a lubricator 52 which is long enough to receive a portion of the plunger above the flow line 48, and is capable of being open or closed by the cap 56.

Ideally, a shock absorber 54 comprising a spring or similar device will cushion the impact of the plunger when it hits the top plate 55 positioned near the top of the lubricator.

As the plunger pin arrives in the lubricator at the well head, the protruding stem 18 engages the top plate 55, as illustrated in FIG. 5A. The impact of this engagement, and the pressure driving the plunger upward, together with the force of the spring 24, will drive the piston downwardly relative to the plunger and will open the valve 32 as illustrated in FIG. 5B.

This allows production fluids (whether gas, condensate or other liquids) to travel through the plunger, out of the ports 40 and into the flow line 48.

In this position with the liquids having been removed from the production stream, the well will begin to flow at a normal rate and the pressure in the wellbore will drop as a result of the resistance in the reservoir.

Figure 6:
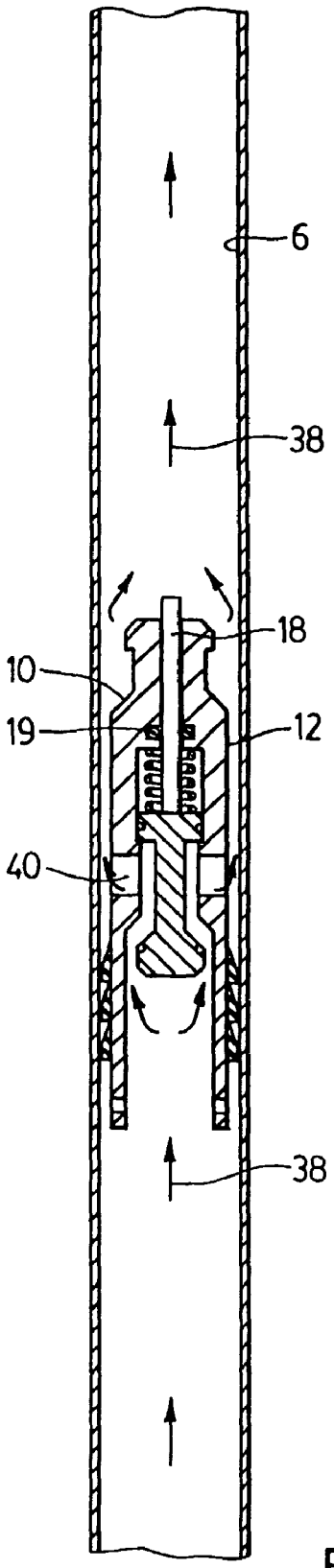
FIG. 6 is a vertical cross-section of the well showing the plunger in the open position while returning to the bottom of the well.

Once the valve has opened the plunger may fall down the well because fluids travelling up the wellbore are permitted to pass through the valve out through the ports 40 through the annular area 12 and up through the top of the wellbore. At the same time the plunger is allowed to fall by its own weight counter to the production flow as illustrated in FIG. 6 and eventually will come to rest on the collar 8 at the bottom of the wellbore as seen in FIG. 1.

In this position the well will continue to produce natural gas until the associated accumulation of water, oil or condensate reaches the critical back pressure necessary to close the valve and start the swabbing cycle all over again.

Figure 7:
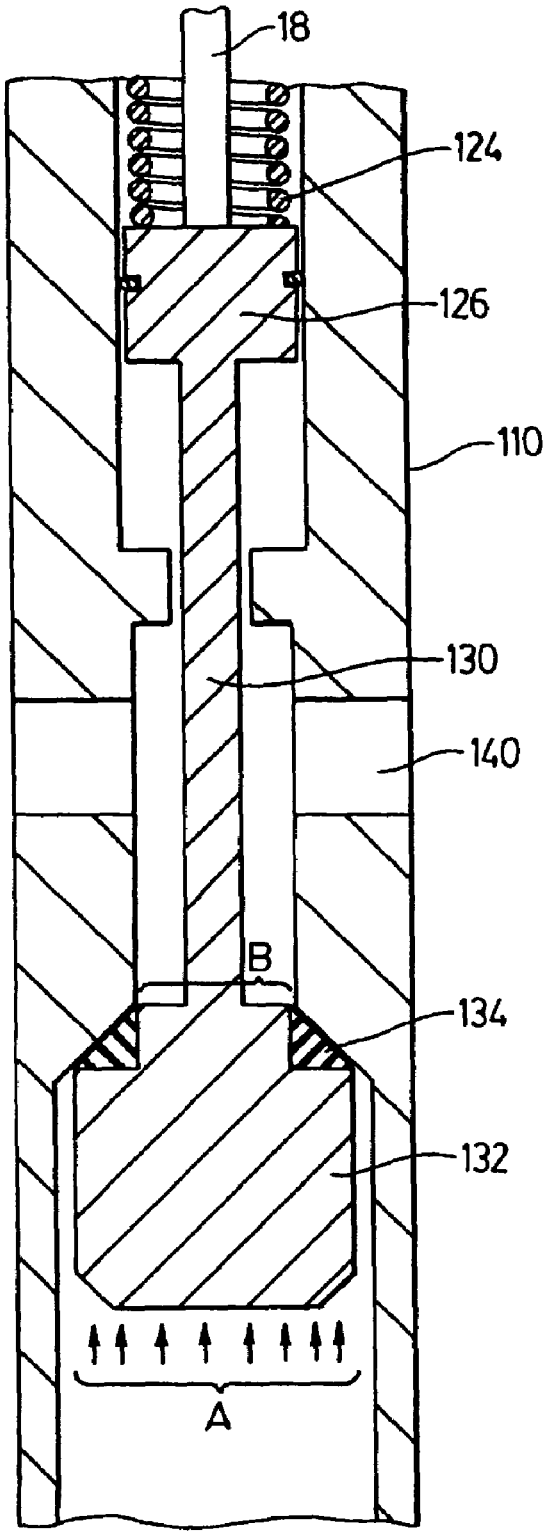
FIG. 7 illustrates a modified version of the pump in FIG. 1.

FIG. 7 represents a modified embodiment of the invention in order to respond more effectively to selected pressure points. In this embodiment the plunger 110 has similar ports 140 and a spring chamber 124 with a piston 126 and an arm 130.

However, in this embodiment the valve 132 has an enlarged shoulder with a seal 134 so that the wellbore pressure acting on the closed valve over the area A has a greater force than the pressure over the valve acting on the smaller cross-sectional are B.

Therefore, once the valve closes to the position shown in FIG. 7, the force, due to wellbore pressure acting on the valve in the closed position, will remain larger than the force tending to open it so that the valve does not immediately open as soon as the pressure drops below the selected pressure point to activate the plunger. The areas may be designated so that the valve will not open until the pressure acting on area A has dropped by a predetermined value such as 30, or 40, or 50 psi.

By virtue of this arrangement the valve will tend to stay closed until the swabbing action is completed and will not tend to open and close eradically when pressure is very slightly above or below the trigger point during the operation of the device.

Figure 8:
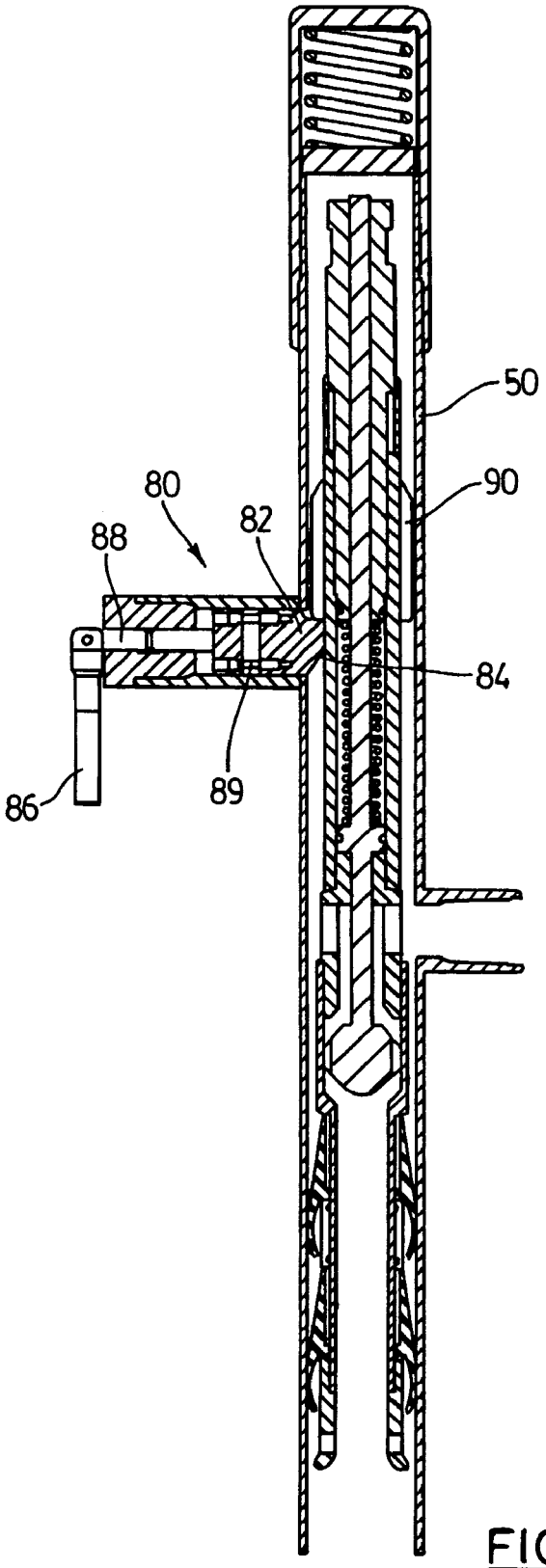
FIG. 8 represents a further modification in which the wellbore pump is associated with a latch mechanism.

In FIG. 8 another modified version of the invention is illustrated in which the plunger is associated with a latch mechanism mounted in the lubricator at the well head.

In this illustrated embodiment the latch mechanism 80 is mounted on the side of the lubricator 50 and has a catch 82 with a tapered face 84 designed so that the plunger can push past the catch but will be restrained from downward movement by engaging the guides 90 on the plunger.

The latch mechanism is provided with a handle 86 to operate a threaded shaft 88 which may be used manually to retract the latch mechanism when it is not to be employed.

It also has a spring loaded sleeve arrangement at 89 which allows the catch 82 to be depressed as the guides of the plunger trave past it, but will allow the catch to re-engage below the guides to prevent the plunger from returning to the bottom of the wellbore.

This device may be engaged or disengaged as necessary, and may be used to prevent the plunger from returning to the wellbore if it is not needed, or if it needs to be removed for repairs.

It will, of course, be realized that numerous other modifications and variations may be employed without departing from the inventive concept herein.

What is claimed is:

1. A wellbore pump for use in a wellbore having cylindrical walls, a lower end and an upper end, the wellbore having a pressurized fluid adjacent the lower end thereof; the wellbore pump comprising:

a plunger having an upper plunger end, a lower plunger end, and cylindrical plunger walls extending from the upper to the lower plunger ends, the cylindrical plunger walls having an external surface facing the cylindrical walls of the wellbore;

a chamber having chamber side walls, an open end and a closed end within the plunger;

a seal on the external surface of the cylindrical plunger walls and providing a seal between the plunger and the cylindrical walls of the wellbore;

a passage in the plunger to permit the pressurized fluid to pass through the plunger from below the seal to above the seal;

a valve in the passage movable between an open position permitting fluid to pass through the passage from below to above the seal to a closed position preventing fluid from passing through the passage from below to above the seal;

a piston within and closing the open end of the chamber and being connected to the valve and mounted for reciprocating movement within the chamber to move the valve between the open and closed positions;

a bias member within the chamber between the piston and the closed end of the chamber, the bias member acting upon the piston to bias the piston in a direction that moves the valve to the open position;

a seal between the piston and the chamber side walls to prevent the pressurized fluid from entering the chamber around the piston and preventing the bias member from being exposed to the pressurized fluid;

the pressurized fluid being exposed to the piston and acting on the piston in a direction opposite from the bias member, whereby when the pressurized fluid reaches a predetermined pressure it will move the piston against the bias of the bias member to cause the valve to move to the closed position.

2. The wellbore pump according to claim 1 wherein pressurized fluid is positioned below the seal.

3. The wellbore pump according to claim 2 wherein the valve has an upper cross-sectional area and a lower cross-sectional area, the upper cross-sectional area being smaller than the lower cross-sectional area.

4. The wellbore pump according to claim 1 wherein the valve has an upper cross-sectional area and a lower cross-sectional area, the upper cross-sectional area being smaller than the lower cross-sectional area.

5. The wellbore pump according to claim 1 wherein the wellbore includes a top plate adjacent the upper end thereof, the piston having a stem extending above the plunger so as to engage the top plate when the plunger moves to the upper end of the wellbore so as to cause the valve to open.

6. The wellbore pump according to claim 2 wherein the wellbore includes a top plate adjacent the upper end thereof, the piston having a stem extending above the plunger so as to engage the top plate when the plunger moves to the upper end of the wellbore so as to cause the valve to open.

7. The wellbore pump according to claim 3 wherein the wellbore includes a top plate adjacent the upper end thereof, the piston having a stem extending above the plunger so as to engage the top plate when the plunger moves to the upper end of the wellbore so as to cause the valve to open.

8. The wellbore pump according to claim 1 and further comprising a latch mechanism mounted adjacent the upper end of the wellbore, the latch mechanism being manually releasable and spring biased to engage the plunger and restrain the plunger from returning to the lower end of the wellbore.

9. The wellbore pump according to claim 2 and further comprising a latch mechanism mounted adjacent the upper end of the wellbore, the latch mechanism being manually releasable and spring biased to engage the plunger and restrain the plunger from returning to the lower end of the wellbore.

10. The wellbore pump according to claim 3 and further comprising a latch mechanism mounted adjacent the upper end of the wellbore, the latch mechanism being manually releasable and spring biased to engage the plunger and restrain the plunger from returning to the lower end of the wellbore.

11. The wellbore pump according to claim 5 and further comprising a latch mechanism mounted adjacent the upper end of the wellbore, the latch mechanism being manually releasable and spring biased to engage the plunger and restrain the plunger from returning to the lower end of the wellbore.

12. A wellbore pump for use in a wellbore having cylindrical walls, an upper end positioned towards the surface and a lower end positioned downhole of the wellbore, the wellbore having an abutment adjacent the upper end, the wellbore collecting a pressurized fluid towards the lower end, the wellbore pump comprising:

a plunger having an upper plunger end, a lower plunger end, and cylindrical plunger walls extending from the upper to the lower plunger ends, the cylindrical plunger walls having an external surface facing the cylindrical walls of the wellbore;

the plunger defining a chamber defined by side walls, an upper end and a lower end, the chamber being isolated from the wellbore;

a seal on the external surface of the cylindrical plunger walls providing a seal between the plunger and the cylindrical walls of the wellbore;

a passage in the plunger to permit the pressurized fluid to pass through the plunger from below the seal to above the seal;

a valve in the passage movable between an open position permitting fluid to pass through the passage from below to above the seal to a closed position preventing fluid from passing through the passage from below to above the seal;

a piston defining the lower end of the chamber in the plunger and being connected to the valve, the piston being mounted for reciprocating movement relative to the plunger to move the passage valve between the open and closed positions;

the piston including a stem sealably extending through an aperture in the upper end of the chamber to a point above the plunger such that when the plunger moves to the upper end of the wellbore it engages the abutment causing the valve to move to the open position;

a bias exerciser within the plunger, the bias exerciser biasing the piston in a direction that moves the valve to the open position;

the pressurized fluid being exposed to the piston and acting on the piston in a direction opposite from the bias of the bias exerciser, whereby when the pressurized fluid reaches a predetermined pressure it will move the piston against the bias of the bias exerciser to cause the valve to move to the closed position.

13. The wellbore pump as claimed in claim 12, wherein the lower end of the wellbore defines perforations allowing gas to enter therethrough, the wellbore pump further comprising a stop positioned above the perforations in the wellbore allowing gas to pass therethrough and limiting the downward movement of the plunger.

14. The wellbore pump as claimed in claim 12, further comprising a seal between the stem and the aperture to prevent the pressurized fluid from entering the chamber.

15. A wellbore pump for use in a wellbore having cylindrical walls, a lower end and an upper end, the wellbore having a pressurized fluid adjacent the lower end thereof the wellbore pump comprising:

a plunger having an upper plunger end, a lower plunger end, and cylindrical plunger walls extending from the upper to the lower plunger ends, the cylindrical plunger walls having an external surface facing the cylindrical walls of the wellbore;

a chamber having chamber side walls, and a closed end within the plunger;

a seal on the external surface of the cylindrical plunger walls and providing a seal between the plunger and the cylindrical walls of the wellbore;

a passage in the plunger to permit the pressurized fluid to pass through the plunger from below the seal to above the seal;

a valve in the passage movable between an open position permitting fluid to pass through the passage from below to above the seal to a closed position preventing fluid from passing through the passage from below to above the seal;

a piston defining a closed space with the chamber and being connected to the valve and mounted for reciprocating movement relative to the plunger to move the valve between the open and closed positions;

a bias exerciser within the chamber between the piston and the closed end of the chamber, the bias exerciser exercising bias upon the piston to bias the piston in a direction that moves the valve to the open position;

a seal between the piston and the chamber side walls to prevent the pressurized fluid from entering the chamber around the piston and preventing the bias exerciser from being exposed to the pressurized fluid;

the pressurized fluid being exposed to the piston and acting on the piston in a direction opposite from the bias exerciser whereby when the pressurized fluid reaches a predetermined pressure it will move the piston against the bias of the bias exerciser to cause the valve to move to the closed position;

and wherein the piston has a stem extending though an aperture in said closed end of the chamber;

and including a seal between the stem and the plunger adjacent said aperture;

and wherein the wellbore includes an abutment adjacent the upper end thereof, the stem engaging the abutment when the plunger moves to the upper end of the wellbore and the stem acting on the piston in a direct, nonresilient manner, to cause the valve to open.

16. The wellbore pump as claimed in claim 15, wherein the lower end of the wellbore defines perforations allowing gas to enter therethrough, the wellbore pump further comprising a stop positioned above the perforations in the wellbore allowing gas to pass therethrough and limiting the downward movement of the plunger.

* * * * *